US008970187B2

(12) United States Patent
Chuan et al.

(10) Patent No.: US 8,970,187 B2
(45) Date of Patent: Mar. 3, 2015

(54) VOLTAGE GENERATOR

(71) Applicant: ISSC Technologies Corp., Hsinchu (TW)

(72) Inventors: Chia-So Chuan, Hsinchu (TW); Tsung-Han Yang, Hsinchu (TW)

(73) Assignee: ISSC Technologies Corp., Hsinchu (TW)

( * ) Notice: Subject to any disclaimer, the term of this patent is extended or adjusted under 35 U.S.C. 154(b) by 94 days.

(21) Appl. No.: 13/773,608

(22) Filed: Feb. 21, 2013

(65) Prior Publication Data

US 2014/0167718 A1 Jun. 19, 2014

(30) Foreign Application Priority Data

Dec. 13, 2012 (TW) ..... 101147281 A

(51) Int. Cl.

| | |
|---|---|
| ***G05F 1/00*** | (2006.01) |
| ***G05F 3/16*** | (2006.01) |
| ***G05F 3/20*** | (2006.01) |
| ***G05F 1/10*** | (2006.01) |

(52) U.S. Cl.

CPC ..... *G05F 1/10* (2013.01)

USPC ..... 323/273; 323/315

(58) Field of Classification Search

USPC ..... 323/273, 281, 282, 283, 315

See application file for complete search history.

(56) References Cited

U.S. PATENT DOCUMENTS

| | | | | |
|---|---|---|---|---|
| 5,629,612 | A * | 5/1997 | Schaffer | 323/313 |
| 5,646,518 | A * | 7/1997 | Lakshmikumar et al. | 323/316 |
| 6,016,051 | A * | 1/2000 | Can | 323/315 |
| 7,173,481 | B2 * | 2/2007 | Kimura | 323/315 |
| 7,453,314 | B2 * | 11/2008 | Hwang et al. | 327/538 |
| 2006/0273772 | A1 * | 12/2006 | Groom | 323/284 |

* cited by examiner

*Primary Examiner* — Jue Zhang

(74) *Attorney, Agent, or Firm* — Jianq Chyun IP Office

(57) ABSTRACT

A voltage generator is disclosed. The voltage generator includes an operational amplifier, an offset voltage tuner, and an output stage circuit. The operational amplifier receives an input voltage and adjusts an offset voltage of the operating amplifier according to a control signal. The offset voltage tuner provides the control signal. The output stage circuit generates an output voltage according to a voltage on an output terminal of the operational amplifier, and provides the output voltage to the operational amplifier.

14 Claims, 5 Drawing Sheets

VOLTAGE GENERATOR

CROSS-REFERENCE TO RELATED APPLICATION

This application claims the priority benefit of Taiwan application serial no. 101147281, filed on Dec. 13, 2012. The entirety of the above-mentioned patent application is hereby incorporated by reference herein and made a part of this specification.

BACKGROUND

1. Technical Field

The invention relates to a voltage generator, and a more particularly to an asymmetric voltage generator.

2. Related Art

FIG. 1 is a circuit diagram of a conventional voltage tuner 100. The voltage tuner 100 includes an operational amplifier 110, a transistor MP, and the resistors Rf1 and Rf2. The operational amplifier 110 has a positive input terminal receiving an input voltage Vref, and a negative input terminal receiving a feedback voltage Vf transmitted back between the resistors Rf1 and Rf2. The transistor MP has a gate coupled to an output terminal of the operational amplifier 110, a source receiving a reference voltage Vin, and a drain connected to a terminal of the resistor Rf2 to generate an output voltage Vout. Another terminal of the resistor Rf2 generates the feedback voltage Vf, and the resistor Rf1 is connected in series between the terminal of resistor Rf2 generating the feedback voltage Vf and a ground voltage GND serving as another reference voltage.

The voltage tuner 100 is referred as a low drop-out (LDO) voltage tuner. Under a condition in which the feedback voltage Vf is equal to the input voltage Vref, a current Ip is equal to Vf/Rf1, and the output voltage Vout is equal to a product of the current Ip and a sum of the resistors Rf1 and Rf2. Therefore, in the voltage tuner 100, when the output voltage Vout is being adjusted, only the resistance of the resistor Rf2 needs to be altered.

It should be noted that, the voltage value of the output voltage Vout and the resistances of the resistors Rf1 and Rf2 are correlated. In order to ensure that the voltage value of the output voltage Vout is accurate, a layout of resistors Rf1 and Rf2 with stable resistances are required for the voltage tuner 100. Therefore, resistors Rf1 and Rf2 with greater widths are needed. On the other hand, in order to reduce the electric energy consumed by the resistors Rf1 and Rf2, these resistors are typically designed to have large resistances. Accordingly, the resistors Rf1 and Rf2 also require greater lengths. In other words, the circuit area occupied by the resistors Rf1 and Rf2 in the conventional voltage tuner 100 is very large which increases the circuit cost.

SUMMARY

The invention provides a voltage generator capable of effectively saving the required circuit area and reducing the electric energy consumed.

The invention provides a voltage generator, including an operational amplifier, an offset voltage tuner, and an output stage circuit. A first input terminal of the operational amplifier receives an input voltage. The operational amplifier receives and adjusts an offset voltage of the operational amplifier according to a control signal. The offset voltage tuner is coupled to the operational amplifier, and the offset voltage tuner provides the control signal. The output stage circuit is coupled to an output terminal and a second input terminal of the operational amplifier. The output stage circuit generates the output voltage according to a voltage on the output terminal of the operational amplifier, and provides the output voltage to the second input terminal of the operational amplifier.

According to an embodiment of the invention, the operational amplifier includes a differential input circuit and a load circuit. The differential input circuit is coupled to a first reference voltage, and the differential input circuit has a first input stage circuit and a second input stage circuit. The conductive resistors of the first and second input stage circuits are adjusted according to the control signal in order to adjust the offset voltage. The load circuit is coupled between the differential input circuit and a second reference voltage, in which a contact of one of the load circuit and the differential input circuit is coupled to the output terminal of the operational amplifier.

According to an embodiment of the invention, the first input stage circuit includes a first transistor and at least one first tuning transistor. The first transistor has a first terminal, a second terminal, and a control terminal. The control terminal of the first transistor receives the input voltage, the first terminal of the first transistor is coupled to the load circuit, and the second terminal of the first transistor is coupled to the second reference voltage. The first tuning transistor has a first terminal, a second terminal, and a control terminal. The control terminal of the first tuning transistor receives the control signal, the first terminal of the first tuning transistor is coupled to the first terminal of the first transistor, and the second terminal of the first tuning transistor is coupled to the second terminal of the first transistor.

According to an embodiment of the invention, the second input stage circuit includes a second transistor and at least one second tuning transistor. The second transistor has a first terminal, a second terminal, and a control terminal. The control terminal of the second transistor receives the input voltage, the first terminal of the second transistor is coupled to the load circuit, and the second terminal of the second transistor is coupled to the second reference voltage. The second tuning transistor has a first terminal, a second terminal, and a control terminal. The control terminal of the second tuning transistor receives the control signal, the first terminal of the second tuning transistor is coupled to the first terminal of the second transistor, and the second terminal of the second tuning transistor is coupled to the second terminal of the second transistor.

According to an embodiment of the invention, the load circuit includes a first resistor and a second resistor, and the first resistor is connected in series between the first input stage circuit and the first reference voltage. The second resistor is connected in series between the second input stage circuit and the first reference voltage.

According to an embodiment of the invention, the load circuit includes a first transistor and a second transistor. The first transistor has a first terminal, a second terminal, and a control terminal. The first terminal of the first transistor is coupled to the first reference voltage, and the second terminal of the first transistor is coupled to the first input stage circuit. The second transistor has a first terminal, a second terminal, and a control terminal. The first terminal of the second transistor is coupled to the first reference voltage, the second terminal of the second transistor is coupled to the second input stage circuit and the control terminal of the second transistor, and the control terminal of the second transistor is coupled to the control terminal of the first transistor.

According to an embodiment of the invention, a channel width to length ratio of the first transistor and/or the second transistor is adjusted according to the control signal.

According to an embodiment of the invention, the offset voltage tuner includes a plurality of first and second voltage selectors. The first voltage selectors are coupled to the operational amplifier. The first voltage selectors generate a first control signal in the control signal according to a selection of the second reference voltage or the input voltage. The second voltage selectors are coupled to the operational amplifier. The second voltage selectors generate a second control signal in the control signal according to a selection of the second reference voltage or the output voltage. The first control signal is transmitted to the first input stage circuit, and the second control signal is transmitted to the second input stage circuit.

According to an embodiment of the invention, the operational amplifier includes a differential input circuit and a load circuit. The differential input circuit is coupled to a first reference voltage, and the differential input circuit has a first input stage circuit and a second input stage circuit. The load circuit is coupled between the differential input circuit and a second reference voltage. The load circuit respectively provides a first impedance and a second impedance to the first and second input stage circuits. The first and second impedances are respectively adjusted according to the control signal.

According to an embodiment of the invention, the load circuit includes a first transistor. The first transistor has a first terminal, a second terminal, and a control terminal. The first terminal of the first transistor is coupled to the first reference voltage, and the second terminal of the first transistor is coupled to the first input stage circuit. A channel width to length ratio of the first transistor is adjusted according to the control signal.

According to an embodiment of the invention, the load circuit further includes a second transistor. The second transistor has a first terminal, a second terminal, and a control terminal. The first terminal of the second transistor is coupled to the first reference voltage, the second terminal of the second transistor is coupled to the second input stage circuit and the control terminal of the second transistor, and the control terminal of the second transistor is coupled to the control terminal of the first transistor. A channel width to length ratio of the second transistor is adjusted according to the control signal.

According to an embodiment of the invention, the offset voltage tuner generates the control signal having at least one bit.

According to an embodiment of the invention, the operational amplifier is a transconductance amplifier.

According to an embodiment of the invention, the output stage circuit includes a first output stage transistor and a second output stage transistor. The first output stage transistor has a first terminal, a second terminal, and a control terminal. The first terminal of the first output stage transistor receives the first reference voltage, the second terminal of the first output stage transistor generates the output voltage, and the control terminal of the first output stage transistor is coupled to the output terminal of the operational amplifier. The second output stage transistor has a first terminal, a second terminal, and a control terminal. The first terminal of the second output stage transistor generates the output voltage, the second terminal of the second output stage transistor is coupled to the second reference voltage, and the control terminal of the second output stage transistor receives an offset voltage.

In summary, by adjusting the offset voltage of the operational amplifier, embodiments of the invention can adjust the voltage value of the output voltage generated by the voltage generator. Therefore, the voltage generator can avoid the use of a large amount of voltage dividing resistors for voltage division. Moreover, the large layout area to compensate for resistance shift due to resistor manufacturing can be reduced. Accordingly, without affecting the accuracy of the output voltage generated by the voltage generator, embodiments of the invention can effectively save on the circuit cost and also reduce the electric energy consumed by the voltage dividing resistors.

Several exemplary embodiments accompanied with figures are described in detail below to further describe the disclosure in details.

BRIEF DESCRIPTION OF THE DRAWINGS

The accompanying drawings constituting a part of this specification are incorporated herein to provide a further understanding of the disclosure. Here, the drawings illustrate embodiments of the disclosure and, together with the description, serve to explain the principles of the disclosure.

DESCRIPTION OF EMBODIMENTS

Figure 1:
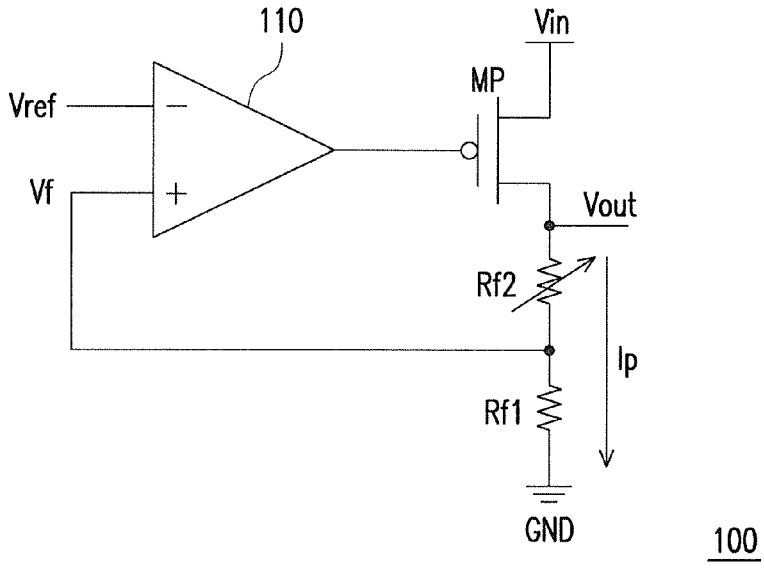
FIG. 1 (RELATED ART)
FIG. 1 is a circuit diagram of a conventional voltage tuner 100.
Figure 2:
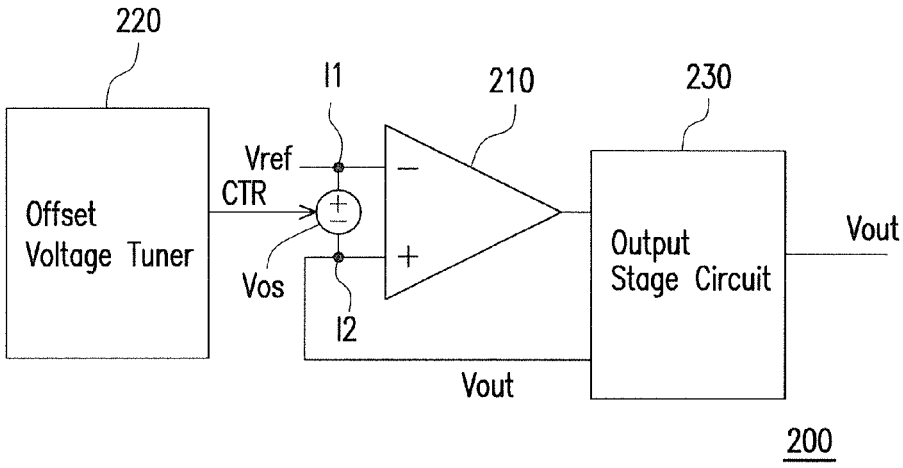
FIG. 2 is a schematic view of a voltage generator 200 according to an embodiment of the invention.

With reference to FIG. 2, a schematic view of a voltage generator 200 according to an embodiment of the invention is depicted. The voltage generator 200 includes an operational amplifier 210, an offset voltage tuner 220, and an output stage circuit 230. The operational amplifier 210 has an input terminal I1 receiving an input voltage Vref, and another input terminal I2 receiving an output voltage Vout. The operational amplifier 210 receives and adjusts an offset voltage Vos of the operational amplifier according to a control signal CTR. Moreover, an output terminal of the operational amplifier 210 is coupled to the output stage circuit 230. The operational amplifier 210 may be a transconductance amplifier.

The offset voltage tuner 220 is coupled to the operational amplifier 210. The offset voltage tuner 220 provides the control signal CTR. The control signal CTR may be formed by one or more of digital signals, and the control signal CTR may also be formed by one or more analog voltages. It should be appreciated that the control signal CTR may also be a hybrid signal formed by one or more analog voltages and digital signals.

The output stage circuit 230 is coupled to the output terminal and the input terminal I2 of the operational amplifier 210. The output stage circuit 230 generates the output voltage Vout according to a voltage on the output terminal of the operational amplifier 210, and provides the output voltage Vout to the input terminal I2 of the operational amplifier 210.

During operation of the voltage generator 200, when the output voltage Vout generated by the voltage generator 200 is adjusted, the offset voltage Vos of the operational amplifier 210 can be adjusted simply through the control signal CTR provided by the offset voltage tuner 220. Accordingly, the voltage on the output terminal of the operational amplifier 210 is also correspondingly adjusted. That is to say, the output stage circuit 230 generating the output voltage Vout according to the voltage on the output terminal of the operational amplifier 210 can also adjust the voltage value of the generated output voltage Vout.

Figure 3:
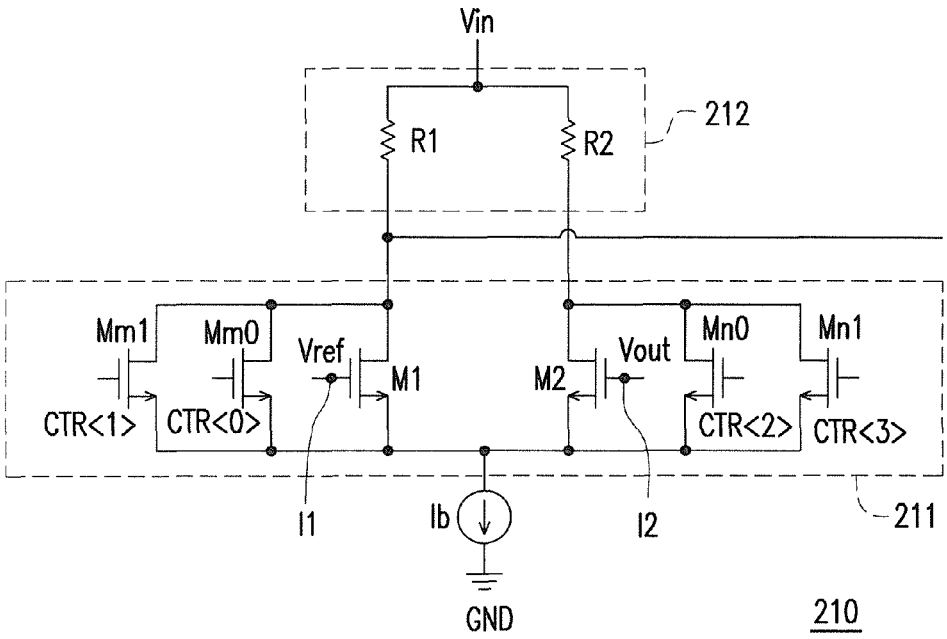
FIG. 3 is a schematic view of an implementation of an operational amplifier 210 according to an embodiment of the invention.

With reference to FIG. 3, a schematic view of an implementation of the operational amplifier 210 according to an embodiment of the invention is depicted. The operational amplifier 210 includes a differential input circuit 211 and a load circuit 212. The differential input circuit 211 has an input stage circuit formed by a transistor M1 and the tuning transistors Mm0 and Mm1, and another input stage circuit formed by a transistor M2 and the tuning transistors Mn0 and Mn1. The load circuit 211 includes the resistors R1 and R2. The resistor R1 is connected in series between the reference voltage Vin and the input stage circuit formed by the transistor M1 and the tuning transistors Mm0 and Mm1. The resistor R2 is connected in series between the reference voltage Vin and the input stage circuit formed by the transistor M2 and the tuning transistors Mn0 and Mn1. Moreover, the operational amplifier 210 further includes a current source Ib, which is connected in series between the ground voltage GND serving as the reference voltage and the input stage circuits.

When the offset voltage of the operational amplifier 210 is adjusted, the offset voltage tuner respectively transmits the control signals CTR<0>-CTR<3> to the control terminals (gates) of the tuning transistors Mm0, Mm1, Mn0, and Mn1. In the present embodiment, the control signals CTR<0>-CTR<1> may be equal to the ground voltage GND or equal to the input voltage Vref, and the control signals CTR<2>-CTR<3> may be equal to the ground voltage GND or equal to the input voltage Vout. Taking the tuning transistor Mm0 as an example, when the control signal CTR<0> received by the control terminal of the tuning transistor Mm0 is equal to the ground voltage GND, the tuning transistor Mm0 is cut off. Moreover, taking the tuning transistor Mn0 as an example, when the control signal CTR<2> received by the control terminal of the tuning transistor Mn0 is equal to the ground voltage GND, the tuning transistor Mn0 is cut off.

Referring to FIG. 2 concurrently, in the present embodiment, when the tuning transistors Mm0, Mm1, Mn0, and Mn1 are all cut off, the output voltage Vout is equal to the input voltage Vin. When the control signals CTR<1>-CTR<3> are all equal to the ground voltage GND, and the control signal CTR<0> is equal to the input voltage Vref, the tuning transistors Mm1, Mn0, and Mn1 are cut off, and the output voltage Vout is equal to a sum of the input voltage Vref and an offset voltage Vosm<0>. The offset voltage Vosm<0> is a voltage difference between a source and a drain of the tuning transistor Mm0. When the control signals CTR<2>-CTR<3> are equal to the ground voltage GND, and the control signals CTR<0>-CTR<1> are equal to the input voltage Vref, the output voltage Vout is equal to a sum of the input voltage Vref, the offset voltage Vosm<0>, and an offset voltage Vosm<1> (Vout=Vref+Vosm<0>+Vosm<1>). The offset voltage Vosm<1> is a voltage difference between a source and a drain of the tuning transistor Mm1.

In comparison, when the control signals CTR<0>-CTR<2> are equal to the ground voltage GND, and the control signal CTR<3> is equal to the output voltage Vout, the output voltage Vout is equal to the input voltage Vref subtracted by the offset voltage Vosn<0>. The offset voltage Vosn<0> is a voltage difference between a source and a drain of the tuning transistor Mn0. When the control signals CTR<0>-CTR<1> are equal to the ground voltage GND, and the control signals CTR<2>-CTR<3> are equal to the output voltage Vout, the output voltage Vout is equal to the input voltage Vref subtracted by the offset voltage Vosn<0> and an offset voltage Vosn<1> (Vout=Vref−Vosn<0>−Vosn<1>). The offset voltage Vosn<1> is a voltage difference between a source and a drain of the tuning transistor Mn1.

The offset voltages Vsm<0>, Vsm<1>, Vsn<0>, and Vsn<1> can be configured by setting the conductive resistors of the tuning transistors Mm0, Mm1, Mn0, and Mn1. A designer may set suitable tuning transistors Mm0, Mm1, Mn0, and Mn1 according to a required adjustable range of the output voltage Vout of the voltage generator 200.

Figure 4:
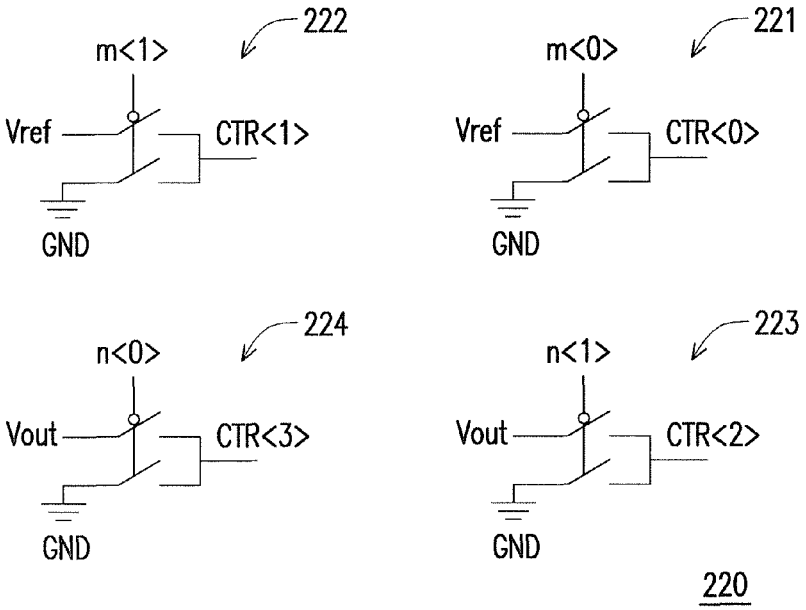
FIG. 4 is a schematic view of an offset voltage tuner 220 according to an embodiment of the invention.

With reference to FIG. 4, a schematic view of the offset voltage tuner 220 according to an embodiment of the invention is depicted. The offset voltage tuner 220 includes a plurality of voltage selectors 221-224. The voltage selectors 221 and 222 respectively selects the input voltage Vref or the ground voltage GND according to the select signals m<0> and m<1> to generate the control signals CTR<0> and CTR<1>. The voltage selectors 223 and 224 respectively selects the output voltage Vout or the ground voltage GND according to the select signals n<0> and n<1> to generate the control signals CTR<2> and CTR<3>. The select signals m<0>-m<1> and n<0>-n<1> may be provided by the circuit controlling the voltage generator 200, or provided by a circuit external to the chip according to the pins of the chip.

Figure 5:
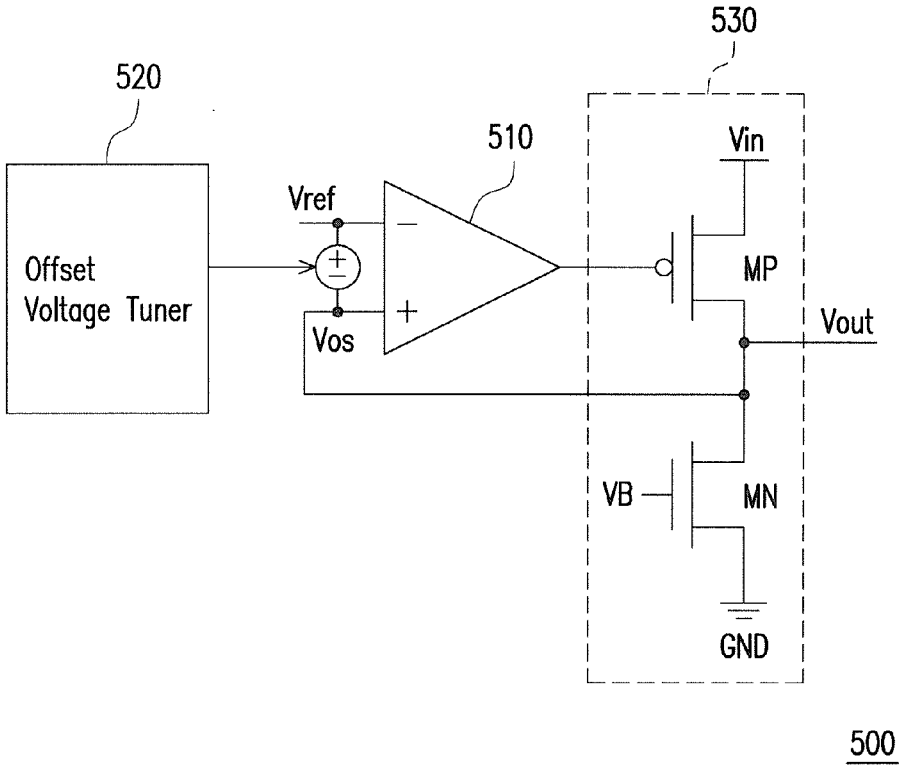
FIG. 5 is a schematic view of a voltage generator 500 according to an embodiment of the invention.

With reference to FIG. 5, a schematic view of a voltage generator 500 according to an embodiment of the invention is depicted. The voltage generator 500 includes an operational amplifier 510, an offset voltage tuner 520, and an output stage circuit 530. The output stage circuit 530 includes an output stage transistor MP and an output stage transistor MN. The output stage transistor MP has a first terminal receiving the reference voltage Vin, a second terminal generating the output voltage Vout, and a control terminal coupled to an output terminal of the operational amplifier 510. A first terminal of the output stage transistor MN is coupled to the second terminal of the output stage transistor MP to generate the output voltage Vout. A second terminal of the output stage transistor MN is coupled to the ground voltage GND serving as the reference voltage. A control terminal of the output stage transistor MN receives an offset voltage VB. The offset voltage VB is a predetermined voltage set according to an actual requirement by design.

It should be noted that, the output stage circuit 530 in the present embodiment do not require voltage dividing resistors to provide the feedback voltage to the operational amplifier 510. Therefore, the issue of resistors which occupy large areas can be resolved, which drastically reduces the circuit cost of the voltage generator 500.

Figure 6A:
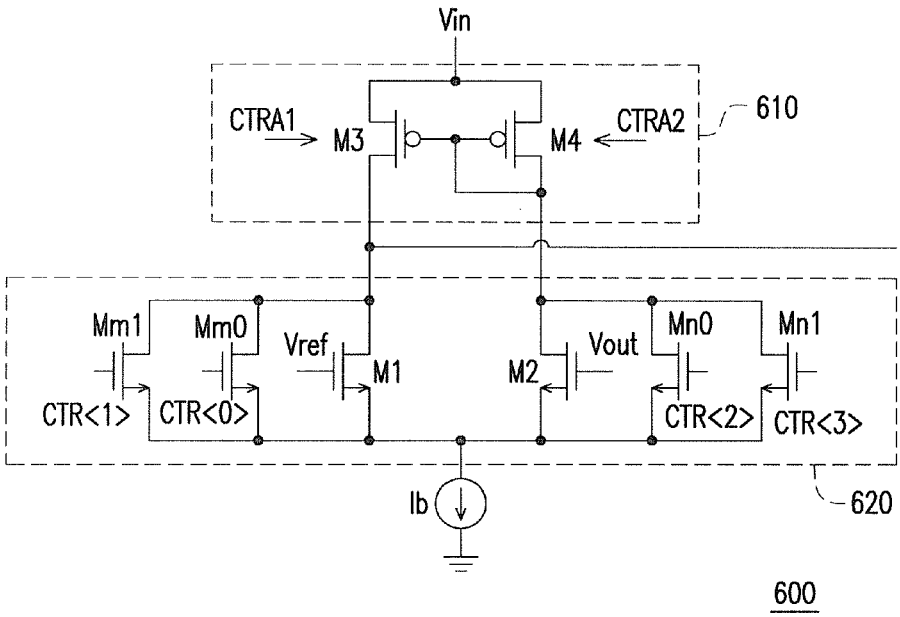
FIG. 6A is a schematic view of another implementation of an operational amplifier according to an embodiment of the invention.

With reference to FIG. 6A, a schematic view of another implementation of an operational amplifier according to an embodiment of the invention is depicted. In FIG. 6A, the operational amplifier 600 includes a load circuit 610, a differential input circuit 620, and a current source Ib. The differential input circuit 620 is similar to the differential input circuit 211 embodied in FIG. 3, and therefore further elaboration thereof is omitted. It should be noted that, the load circuit 610 is an active load, and the load circuit 610 includes the transistors M3 and M4. The transistor M3 has a first terminal coupled to the reference voltage Vin, and a second terminal coupled to the differential input circuit 620. The transistor M4 has a control terminal coupled to a control terminal of the transistor M3, a first terminal coupled to the reference voltage Vin, and a second terminal coupled to the differential input circuit 620 and the control terminal of the transistor M4.

In the present embodiment, the transistors M3 and M4 respectively provide two resistances to the transistors M1 and M2. It should be noted that, when the output voltage Vout is adjusted, besides tuning the differential input circuit 620, the resistances provided by the transistors M3 and M4 can also be tuned to adjust the output voltage Vout. In the present embodiment, the transistors M3 and M4 respectively or simultaneously adjust their conductive resistors according to the control signals CTRA1 and CTRA2 (e.g., by adjusting the channel width to length ratio of the transistor (W/L)).

Figure 6B:
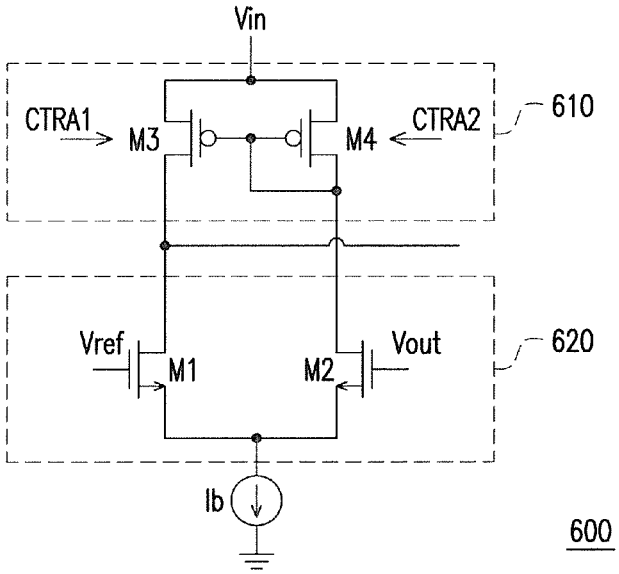
FIG. 6B is a schematic view of another implementation of an operational amplifier according to an embodiment of the invention.

With reference to FIG. 6B, a schematic view of another implementation of an operational amplifier according to an embodiment of the invention is depicted. In FIG. 6B, the differential input circuit 620 does not provide a mechanism to adjust the offset voltage. In other words, in the embodiment of FIG. 6B, the magnitude of the output voltage Vout can be determined solely by adjusting the impedances provided by the transistors M3 and M4.

Figure 7A:
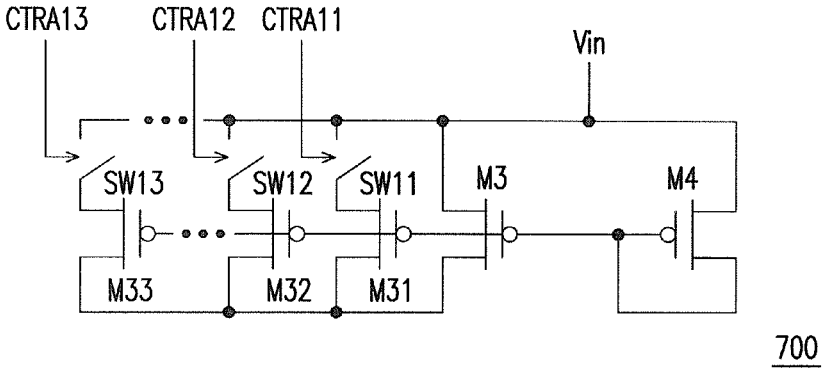
FIGS. 7A-7C are schematic views of an impedance adjustment for a load circuit according to an embodiment of the invention.
Figure 7B:
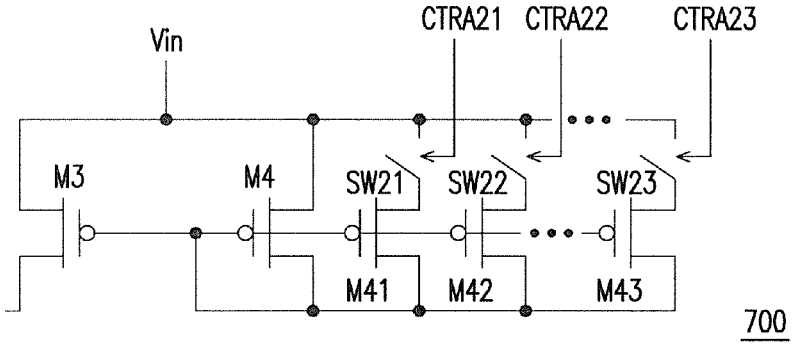
Figure 7C:
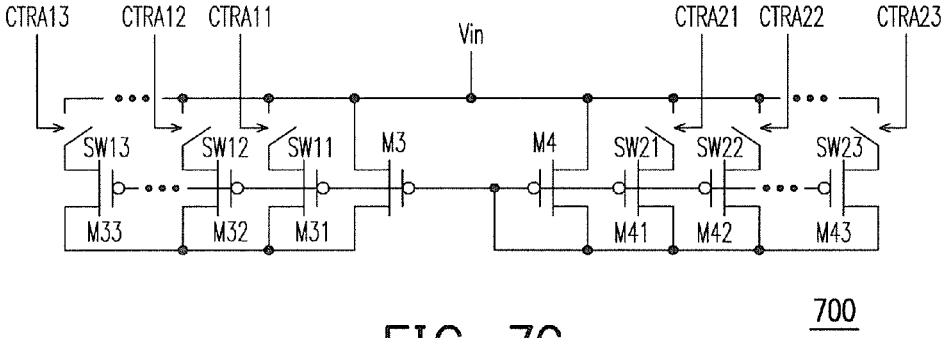

With reference to FIGS. 7A-7C, schematic views of an impedance adjustment for a load circuit according to an embodiment of the invention are depicted. In FIG. 7A, a load circuit 700 includes the transistors M3, M4, and M31-M33, and the switches SW11-SW13. The transistors M31-M33 have control terminals (gates) coupled to a control terminal of the transistor M3, sources coupled to a source of the transistor M3 through the switches SW11-SW13, and drains commonly coupled to a drain of the transistor M3. The switches SW11-SW13 are respectively controlled by the control signals CTRA11-CTRA13 to conduct or break off. As the number of conducting switches SW11-SW13 increases, the equivalent channel width to length ratios of the transistor M3 and the transistors M31-M33 become larger, and the equivalent conductive impedances provided by the transistor M3 and the transistors M31-M33 are lowered. As the number of conducting switches SW11-SW13 decreases, the equivalent channel width to length ratios of the transistor M3 and the transistors M31-M33 become smaller, and the equivalent conductive impedances provided by the transistor M3 and the transistors M31-M33 are increased.

In FIG. 7B, the load circuit 700 includes the transistors M3, M4, and M41-M43, and the switches SW21-SW23. The transistors M41-M43 have control terminals (gates) coupled to a control terminal of the transistor M4, sources respectively bridged to a source of the transistor M4 through the switches SW21-SW23, and drains coupled to a drain of the transistor M4. The switches SW21-SW23 are respectively controlled by the control signals CTRA21-CTRA23 to conduct or break off. As the number of conducting switches SW21-SW23 increases, the equivalent channel width to length ratios of the transistor M4 and the transistors M41-M43 become larger, and the equivalent conductive impedances provided by the transistor M4 and the transistors M41-M43 are lowered. By comparison, as the number of conducting switches SW21-SW23 decreases, the equivalent channel width to length ratios of the transistor M4 and the transistors M41-M43 become smaller, and the equivalent conductive impedances provided by the transistor M4 and the transistors M41-M43 are increased.

FIG. 7C is a combination of the embodiments shown in FIGS. 7A and 7B. In other words, the equivalent width to length ratios of the transistor M3 and the transistors M31-M33 and the equivalent width to length ratios of the transistor M4 and the transistors M41-M43 can be simultaneously adjusted, respectively, such that the offset voltage of the operational amplifier can be more flexibly adjusted.

It should be noted that, the control signals CTRA11-CTRA13 and CTRA21-CTRA23 in FIGS. 7A-7C may be digital logic signals.

In view of the foregoing, by adjusting the offset voltage of the operational amplifier, embodiments of the invention can adjust the voltage value of the output voltage generated by the voltage generator. No variable resistors need to be constructed in the invention to serve as the basis for the adjustments. Accordingly, the voltage generator do not require large area resistors, and circuit cost can be saved effectively.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A voltage generator, comprising:

an operational amplifier having a first input terminal, a second input terminal, and an output terminal, the first input terminal receiving an input voltage, and receiving and adjusting an offset voltage of the operational amplifier according to a control signal;

an offset voltage tuner coupled to the operational amplifier, the offset voltage tuner providing the control signal; and an output stage circuit coupled to the output terminal and the second input terminal of the operational amplifier, the output stage circuit generating an output voltage according to a voltage on the output terminal of the operational amplifier, and providing the output voltage to the second input terminal of the operational amplifier, wherein the operational amplifier comprises:

a differential input circuit coupled to a first reference voltage, the differential input circuit having a first input stage circuit and a second input stage circuit, wherein the conductive resistors of the first and second input stage circuits are adjusted according to the control signal in order to adjust the offset voltage; and a load circuit coupled between the differential input circuit and a second reference voltage, wherein a contact of one of the load circuit and the differential input circuit is coupled to the output terminal of the operational amplifier.

2. The voltage generator of claim 1, wherein the first input stage circuit comprises:

a first transistor having a first terminal, a second terminal, and a control terminal, the control terminal of the first transistor receiving the input voltage, the first terminal of the first transistor coupled to the load circuit, and the second terminal of the first transistor coupled to the second reference voltage; and at least one first tuning transistor, the first tuning transistor having a first terminal, a second terminal, and a control terminal, the control terminal of the first tuning transistor receiving the control signal, the first terminal of the first tuning transistor coupled to the first terminal of the first transistor, and the second terminal of the first tuning transistor coupled to the second terminal of the first transistor.

3. The voltage generator of claim 2, wherein the second input stage circuit comprises:

a second transistor having a first terminal, a second terminal, and a control terminal, the control terminal of the second transistor receiving the input voltage, the first terminal of the second transistor coupled to the load circuit, and the second terminal of the second transistor coupled to the second reference voltage; and at least one second tuning transistor, the second tuning transistor having a first terminal, a second terminal, and a control terminal, the control terminal of the second tuning transistor receiving the control signal, the first terminal of the second tuning transistor coupled to the first terminal of the second transistor, and the second terminal of the second tuning transistor coupled to the second terminal of the second transistor.

4. The voltage generator of claim 1, wherein the second input stage circuit comprises:

a first transistor having a first terminal, a second and a control terminal, the control terminal of the first transistor receiving the input voltage, the first terminal of the first transistor coupled to the load circuit, and the second terminal of the first transistor coupled to the second reference voltage; and at least one first tuning transistor, the first tuning transistor having a first terminal, a second terminal, and a control terminal, the control terminal of the first tuning transistor receiving the control signal, the first terminal of the first tuning transistor coupled to the first terminal of the first transistor, and the second terminal of the first tuning transistor coupled to the second terminal of the first transistor.

5. The voltage generator of claim 1, wherein the load circuit comprises:

a first resistor and a second resistor, the first resistor connected in series between the first input stage circuit and the first reference voltage, and the second resistor connected in series between the second input stage circuit and the first reference voltage.

6. The voltage generator of claim 1, wherein the load circuit comprises:

a first transistor having a first terminal, a second terminal, and a control terminal, the first terminal of the first transistor coupled to the first reference voltage, and the second terminal of the first transistor coupled to the first input stage circuit; and a second transistor having a first terminal, a second terminal, and a control terminal, the first terminal of the second transistor coupled to the first reference voltage, the second terminal of the second transistor coupled to the second input stage circuit and the control terminal of the second transistor, and the control terminal of the second transistor coupled to the control terminal of the first transistor.

7. The voltage generator of claim 6, wherein a channel width to length ratio of the first transistor and/or the second transistor is adjusted according to the control signal.

8. The voltage generator of claim 1, wherein the offset voltage tuner comprises:

a plurality of first voltage selectors coupled to the operational amplifier, the first voltage selectors generating a first control signal in the control signal according to a selection of the second reference voltage or the input voltage; and a plurality of second voltage selectors coupled to the operational amplifier, the second voltage selectors generating a second control signal in the control signal according to a selection of the second reference voltage or the output voltage, wherein the first control signal is transmitted to the first input stage circuit, and the second control signal is transmitted to the second input stage circuit.

9. The voltage generator of claim 1, wherein the operational amplifier comprises:

a differential input circuit coupled to the first reference voltage, the differential input circuit having a first input stage circuit and a second input stage circuit; and a load circuit coupled between the differential input circuit and the second reference voltage, wherein the load circuit respectively provides a first impedance and a second impedance to the first and second input stage circuits, wherein the first and second impedances are respectively adjusted according to the control signal.

10. The voltage generator of claim 9, wherein the load circuit comprises:

a first transistor having a first a second and a control terminal, the first terminal of the first transistor coupled to the first reference voltage, and the second terminal of the first transistor coupled to the first input stage circuit, wherein a channel width to length ratio of the first transistor is adjusted according to the control signal.

11. The voltage generator of claim 10, wherein the load circuit further comprises:

a second transistor having a first terminal, a second terminal, and a control terminal, the first terminal of the second transistor coupled to the first reference voltage, the second terminal of the second transistor coupled to the second input stage circuit and the control terminal of the second transistor, and the control terminal of the second transistor coupled to the control terminal of the first transistor, wherein a channel width to length ratio of the second transistor is adjusted according to the control signal.

12. The voltage generator of claim 9, wherein the offset voltage tuner generates the control signal having at least one bit.

13. The voltage generator of claim 1, wherein the operational amplifier is a transconductance amplifier.

14. The voltage generator of claim 1, wherein the output stage circuit comprises:

a first output stage transistor having a first terminal, a second terminal, and a control terminal, the first terminal of the first output stage transistor receiving the first reference voltage, the second terminal of the first output stage transistor generating the output voltage, and the control terminal of the first output stage transistor coupled to the output terminal of the operational amplifier; and a second output stage transistor having a first terminal, a second terminal, and a control terminal, the first terminal of the second output stage transistor generating the output voltage, the second terminal final of the second output stage transistor coupled to the second reference voltage, and the control terminal of the second output stage transistor receiving an offset voltage.

* * * * *